US007083047B2

(12) United States Patent
Bone et al.

(10) Patent No.: US 7,083,047 B2
(45) Date of Patent: Aug. 1, 2006

(54) POLYMERIC FILM FOR WATER SOLUBLE PACKAGE

(75) Inventors: Gavin Bone, Henlow (GB); Robert Walter Fuss, Liederbach (DE); Craig Warren Jones, Wirral (GB); Steven Paul Rannard, Wirral (GB); Michael Stephen White, Wirral (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 240 days.

(21) Appl. No.: 10/678,470

(22) Filed: Oct. 3, 2003

(65) Prior Publication Data

US 2004/0065578 A1 Apr. 8, 2004

(30) Foreign Application Priority Data

Oct. 3, 2002 (GB) ..... 0222964.9

(51) Int. Cl.

| | |
|---|---|
| ***B65D 85/84*** | (2006.01) |
| ***C08J 5/18*** | (2006.01) |
| ***C08J 7/00*** | (2006.01) |
| ***C11D 17/04*** | (2006.01) |

(52) U.S. Cl. ..... 206/524.7; 525/56; 525/61; 209/1; 510/276

(58) Field of Classification Search ..... 206/524.7; 525/56, 61; 209/1; 510/276

See application file for complete search history.

(56) References Cited

U.S. PATENT DOCUMENTS

| | | | | |
|---|---|---|---|---|
| 4,082,678 A | | 4/1978 | Pracht et al. | 252/8.5 |
| 4,765,916 A | | 8/1988 | Ogar, Jr. et al. | |
| 4,846,992 A | | 7/1989 | Fonsny | |
| 4,973,416 A | | 11/1990 | Kennedy | |
| 5,135,982 A | * | 8/1992 | Matsumoto et al. | 525/61 |
| 6,204,223 B1 | | 3/2001 | Holmes et al. | 504/366 |

FOREIGN PATENT DOCUMENTS

| | | | |
|---|---|---|---|
| AT | 408548 B | * | 11/2001 |
| AT | 408548 | | 12/2001 |
| BE | 9700361 | | 5/1999 |
| DE | 27 49 555 | | 5/1978 |
| DE | 27 49 555 A1 | | 5/1978 |
| DE | 195 21 140 A1 | | 12/1996 |
| DE | 298 01 621 U1 | | 4/1998 |
| EP | 0 079 712 B2 | | 5/1983 |
| EP | 0 157 162 B1 | | 10/1985 |
| EP | 0 158 464 B1 | | 10/1985 |
| EP | 0 160 254 B1 | | 11/1985 |
| EP | 0 283 180 B1 | | 9/1988 |
| EP | 0 284 334 A2 | | 9/1988 |
| EP | 0 291 198 B1 | | 11/1988 |
| EP | 332 175 | | 9/1989 |
| EP | 0 347 221 B1 | | 12/1989 |
| EP | 0 389 513 B1 | | 10/1990 |
| EP | 507 404 | | 10/1992 |
| EP | 0 518 689 B1 | | 12/1992 |
| EP | 0 593 952 A1 | | 4/1994 |
| EP | 0 700 989 B1 | | 3/1996 |
| EP | 0 941 939 A1 | | 9/1999 |
| FR | 2 601 930 A1 | | 1/1988 |
| FR | 2 724 388 A1 | | 3/1996 |
| GB | 1031831 | | 6/1966 |
| GB | 1 594 102 | | 7/1981 |
| GB | 2 090 603 A | | 7/1982 |
| GB | 2 118 961 A | | 11/1983 |
| GB | 2 305 931 A | | 4/1997 |
| GB | 2 358 382 A | | 7/2001 |
| WO | 96/00251 | | 1/1996 |
| WO | 97/00282 | | 1/1997 |
| WO | 97/19961 | | 6/1997 |
| WO | WO 9719961 A1 | * | 6/1997 |
| WO | 97/27743 | | 8/1997 |
| WO | 97/31903 | | 10/1997 |
| WO | 00/06688 | | 2/2000 |
| WO | 00/51724 | | 9/2000 |
| WO | 00/55044 | | 9/2000 |
| WO | 00/55045 | | 9/2000 |
| WO | 00/55046 | | 9/2000 |
| WO | 00/55068 | | 9/2000 |
| WO | 00/55069 | | 9/2000 |
| WO | 00/55415 | | 9/2000 |
| WO | 01/79417 | | 10/2001 |
| WO | 01/85892 | | 11/2001 |
| WO | 02/102956 | | 12/2002 |
| WO | 03/068852 | | 8/2003 |
| WO | 2004/031271 | | 4/2004 |

OTHER PUBLICATIONS

UK Search Report No. GB0222964.9 dated May 16, 2003—1 page.

Schambil et al., "Detergent Tabs—One year after their Pan-European Launch", *Tenside Surf. Det.* 36 (2000) 1.

Japanese Abstract JP 63046233 published Aug. 13, 1986.

* cited by examiner

*Primary Examiner*—Kelechi C. Egwim
(74) *Attorney, Agent, or Firm*—Rimma Mitelman

(57) ABSTRACT

A water soluble package comprises a polymeric film, the polymeric film comprising a polymeric backbone derived from a polymer which is water soluble, as defined herein, and one or more derivatising groups attached to the backbone, the derivatising group(s) being derived from a material having a ClogP of from 0.5 to 6 and/or being derived from a parent material comprising a C4 to C22 hydrocarbyl chain.

16 Claims, No Drawings

POLYMERIC FILM FOR WATER SOLUBLE PACKAGE

FIELD OF THE INVENTION

The present invention relates to a polymeric film for a water soluble package and a water soluble package for containing a fabric treatment composition, such as a rinse treatment composition.

BACKGROUND AND PRIOR ART

Rinse added fabric conditioning compositions are well known. Typically, such compositions are provided as a liquid in a plastics bottle which requires the consumer to dose the correct amount of the fabric softening composition from the bottle into the dispensing drawer of a washing machine.

The problem with conventional liquid fabric softeners provided in a bottle or other such package is that there is always a risk of underdosing or overdosing the rinse conditioning composition into the dispenser drawer of a washing machine resulting in a unsatisfactory or undesired level of softening being provided to fabrics. There is also the problem of spillage of the ingredients when pouring the product from the package into the dispensing drawer of a washing machine.

Therefore, it is desirable to provide a rinse conditioning composition which is convenient to use and guarantees that the correct amount of fabric softening composition is dosed into the rinse cycle. It is also desirable to avoid the problem of spillage of the product associated with the dispensing of conventional rinse conditioners from a bottle or the like.

Water soluble packages are known in the detergent and agrochemical industries and generally comprise either vertical form-fill-seal (VFFS) envelopes or thermoformed envelopes. In one of the VFFS processes, a roll of water soluble film is sealed along its edges to form a tube, which tube is heat sealed intermittently along its length to form individual envelopes which are filled with product and heat sealed. The thermoforming process generally involves moulding a first sheet of water soluble film to form one or more recesses adapted to retain a composition, such as for example a solid agrochemical composition, placing the composition in the at least one recess, placing a second sheet of water soluble material over the first so as to cover the or each recess, and heat sealing the first and second sheets together at least around the recesses so as to form one or more water soluble packages.

Cleaning products are traditionally often liquids, viscous or thin, such as known for personal cleaning (bath and shower liquids and shampoos) or for domestic cleaning (hand dish wash and other hard surface cleaning, laundry-cleaning etc.). Other products are solids, such as powders, granules, small capsules (up to 2 mm diameter) or more recently tablets, for laundry and machine dish wash, and soap bars for skin cleaning. Recently, so called unit dose products are experiencing an increasing success with consumers, because they eliminate the need for manipulating, and possibly spilling, liquids or powders and simplify the use of a correct dose of the product for the required purpose. Examples thereof are the laundry and machine dish wash tablets mentioned above and recently described in F. Schambil and M. Böcker, Tenside Surf. Det. 37 (2000) 1.

Many types of water soluble packages are known, including packages made from polyvinyl alcohol (hereinafter referred to as "PVOH") film. A wide variety of different materials can be packaged in such films, including liquid materials.

EP-A-518689 discloses a containerisation system for hazardous materials (for example pesticides) comprising a PVOH film enclosing a composition comprising the hazardous material, water, an electrolyte and optional other materials. The electrolyte is added to reduce the solubility of the film to prevent its dissolution by the packaged composition.

WO9737903 discloses films for the encapsulation of agro-chemicals. There is no suggestion of films designed to respond to surfactant concentration.

EP-B-389513 discloses concentrated aqueous syrups (mainly foodstuffs but other materials such as detergents are mentioned) inside PVOH packages, the concentration of the syrup being effective to prevent dissolution of the package by the packaged composition.

EP-A-700989 discloses a unit packaged detergent for dish washing, the package comprising a detergent composition wrapped in PVOH film, wherein the film protects the detergent from dissolution until the main wash cycle of the dish washing machine.

WO-A-97/27743 discloses an agrochemical composition packaged in a water soluble sachet, which can be PVOH.

GB-A-2118961 discloses bath preparations packaged in PVOH film, while EP-B-347221 relates to water-soluble sachets of phytosanitary materials which are packaged in a secondary water-insoluble pack with a humid environment being maintained between the two.

EP-A-593952 discloses a water soluble sachet of PVOH with two chambers and a treatment agent for washing inside each chamber.

EP-A-941939 relates to a water soluble package, which can be PVOH, containing a composition which, when dissolved, produces a solution of known composition.

GB-A-2305931 discloses a dissolvable laundry sachet and BE-9700361 relates to a water soluble unit-dosed cleaning agent, especially for cleaning hands.

DE-29801621 discloses a water soluble unit dose for dishwashing machines.

EP-B-160254 relates to a washing additive comprising a mixture of detergent constituents in a PVOH bag. The detergent comprises nonionic surfactant and a quaternary ammonium compound. U.S. Pat. No. 4,846,992 discloses a double-packaged laundry detergent wherein the inner package is water-soluble and can be PVOH.

EP-B-158464 relates to a detergent mull packaged in PVOH and DE-A-19521140 discloses a water soluble PVOH sachet containing a detergent composition.

FR-2601930 relates to a water soluble sachet containing any substance, particularly a pharmaceutical.

A variety of water soluble PVOH films are also known. For example, EP-B-157162 relates to a self-supporting film comprising a PVOH matrix having rubbery microdomains dispersed therein.

WO-A-96/00251 relates to an amphipathic graft copolymer comprising a hydrophobic backbone with grafting sites to which are grafted a hydrophilic polymer prepared from a hydrophilic monomer containing stabilising pH independent ionic groups.

GB-B-2090603 relates to a water soluble film comprising a uniform mixture of partially hydrolysed polyvinyl acetate and polyacrylic acid.

WO-A-97/00282 relates to a water soluble film combining two polymeric ingredients S and H where S is a soft acid-functional olefinic addition copolymer having a Tg less than 20° C. and H is a hard acid-functional olefinic addition copolymer having a Tg less than 40° C. The ratio of S:H is from 90:10 to 65:35 and the acid functionalities are at least partially neutralised to render the film water soluble.

EP-B-79712 relates to a laundry additive for discharge to a wash containing borate ions. The additive is enclosed within a film of PVOH which is plasticised and has as a solubiliser either a polyhydroxy compound (such as sorbitol) or an acid (such as polyacrylic acid).

EP-B-291198 relates to a water soluble film containing an alkaline or borate-containing additive. The film is formed from a copolymer resin of vinyl alcohol having 0–10 mole % residual acetate groups and 1–6 mole % of a non-hydrolysable anionic comonomer. FR-2724388 discloses a water soluble bottle, flask or drum made from PVOH which is plasticised with 13–20% of plasticiser (such as glycerol) and then moulded.

The specifications of International Patent Applications WO-A-00/55044, WO-A-00/55045, WO-A-00/55046, WO-A-00/55068, WO-A-00/55069 and WO-A-00/55415 disclose water soluble packages containing a fluid substance (defined as a liquid, gel or paste) which is a horizontal form-fill-seal (HFFS) envelope. These packages comprise a body wall portion having internal volume and which is preferably dome-shaped, formed from a first sheet, and a superposed base wall portion, formed from a second sheet, seded to the body wall portion.

A PVOH package containing a liquid laundry detergent composition comprising from about 10% to about 24% by weight of water (but 3.57% in the sole example) is disclosed in U.S. Pat. No. 4,973,416.

EP0283180 discloses the preparation of very fast dissolving films with a high degree of hydrolysis.

WO-A1-97/19961 discloses fast solubility polymers, made from PVOH co-polymerized with carboxylate moieties, and have some degree of lactonization. These materials dissolve quickly in detergent solution. There is no reference or suggestion to control of solubility using washing surfactants.

EP0284334 relates to films comprising a blend of PVOH and alkyl celluloses with a metal salt, such as borate, to produce a triggered pouch. The alkyl cellulose is present to respond to temperature such that at low rinse temperatures it is more soluble than at the higher temperatures associated with the wash cycle. The borate cross linking provides pH sensitivity. Furthermore, this document discloses that anionic surfactants have very little effect on or even increase the rate of dissolution of the film.

GB2358382 relates to rigid blow molded components made from PVOH.

AT408548 concerns PVOH materials that contain builders for the improvement of detergency during the wash cycle.

When formulating a liquid unit dose product of the kind wherein a substantially non-aqueous formulation is encapsulated in a water soluble film, probably the most difficult challenge is to preserve the physical integrity and stability of the film. One approach to this problem is disclosed in WO-A1-01/79417, which involves substantially neutralising, or over-neutralising any acidic components in the liquid composition, especially any fatty acids and/or acid precursors of anionic surfactant. However, this approach is specific to encapsulation using a water-soluble film based on PVOH which includes comonomer units having carboxyl functionality.

Preservation of the integrity of films which contain fabric softening compositions for use in the rinse cycle is particularly challenging since commercial softening compositions are generally aqueous and tend to interact undesirably with water soluble packaging causing a weakening of the film and potentially premature breakage, e.g. during storage.

One way of addressing this problem is disclosed in U.S. Pat. No. 4,765,916 which involves providing a cross-linked polymeric water soluble film, preferably a borate.

Where the package is to deliver a fabric softening composition, it is important that the contents are delivered primarily during the rinse cycle.

In the case of so-called "top-loading" washing machines where the fabric conditioning product is typically dosed directly into the drum of the washing machine, this usually requires that the consumer to be present both at the beginning of the wash cycle and at the beginning of the rinse cycle to dose the wash and rinse products respectively.

Accordingly, it is desirable to be able to provide a product which can be dosed into the washing machine drum at the beginning of the wash cycle but does not disperse or release its contents until the rinse cycle.

One way of addressing this problem is set out in WO-A1-02/102956, where a water soluble package is provided which is soluble in response to, for instance, the change in pH and/or ionic strength from the wash liquor to the rinse liquor. However, the variety of machines and wash conditions means that changes in pH and/or ionic strength can vary enormously. Therefore, it is also desirable to provide a water soluble package which can be dosed into the wash cycle and which is triggered in the rinse cycle by an alternative means.

WO-A-01/85892 discloses highly concentrated conditioners with PVOH film receptacles which are added to the rinse compartment of the dosing drawer. The receptacle enters the rinse bath when the rinse cycle starts.

WO-A-00/51724 discloses the use of molecular sieves for controlled release of fabric treatment products.

WO-A-00/06688 relates to PVOH films which are modified with an amine group. The film releases its contents due to a change in pH during the laundry cycle.

DE-A-2749555 discloses a two fold laminate with a washing pouch, released during the rinse. However, an insoluble bag remains after the laundry cycle is complete. Furthermore, the polymers discloses therein are not hydrophobically modified.

OBJECTS OF THE INVENTION

The present invention seeks to address one or more of the above-mentioned problems and to provide one or more of the above-mentioned benefits.

The inventors have now found that a water soluble package can be chemically modified so that the rate at which it breaks down, e.g. dissolves, disperses or otherwise disintegrates, is dependent on the concentration of washing detergent present in a liquor.

In particular, it has been found that by modifying the structure of a water soluble polymeric film, such as a PVOH film, with a modifying group, e.g. with a specific acetal group, the film remains substantially intact in the presence of an anionic and/or nonionic detergent, e.g. during the wash cycle of a laundry operation, and disintegrates when the concentration of the detergent reduces sufficiently, e.g. during the rinse cycle of the laundry operation.

SUMMARY OF THE INVENTION

Thus, according to the present invention there a water soluble package for use in the rinse cycle of a washing machine comprising a polymeric film, the polymeric film comprising a polymeric backbone derived from a polymer which is water soluble, as defined herein, and one or more derivatising groups attached to the backbone, the derivatising group(s) being derived from a material having a ClogP of from 0.5 to 6.

According to another aspect of the invention, a water soluble package comprises a polymeric film, the polymeric film comprising a polymeric backbone derived from a polymer which is water soluble, as defined herein, and one or more derivatising groups attached to the backbone, the derivatising group(s) being derived from a parent material comprising a C4 to C22 hydrocarbyl chain.

According to yet another aspect of the invention, a water soluble package comprises a polymeric film, the polymeric film comprising a polymeric backbone derived from a polymer which is water soluble, as defined herein, and one or more derivatising groups attached to the backbone wherein the package has a relative rupture ratio of greater than 1, more preferably greater than 3 most preferably greater than 7.

Preferably, the water soluble package has a solubility or dispersibility in anionic or combinations of anionic/nonionic surfactants of more than 15 minutes when the surfactant concentration in water is greater than 0.05 g/L and a solubility or dispersibility of less than 15 minutes when the surfactant concentration in water is less than 0.05 g/L.

Preferably the parent material from which the derivatising group is obtained is an aldehyde.

It is particularly desirable that the polymeric film is capable of forming, upon contact with a detergent surfactant in a micellar or liquid crystalline form, a gelled network having a viscosity or an apparent molecular weight greater than the molecular weight of the polymeric film alone.

In a further aspect, the invention provides a process for conditioning fabrics comprising the steps of adding to a laundry cycle of a washing machine the water soluble package as described herein and contacting the contents of the package with fabric in the drum of the washing machine.

In this process, it is preferred that the tendency of the water soluble package to break down is reduced in the presence of a fabric wash detergent active.

DETAILED DESCRIPTION OF THE INVENTION

The water soluble package and any contents present therein must be compatible with each other. By "compatible" is meant that in an inert atmosphere free of moisture and at a temperature of from 5 to 40° C., the water soluble package with the rinse conditioner contents therein does not rupture or release any contents within 4 weeks, more preferably 8 weeks, most preferably 20 weeks.

Polymeric Film

The polymeric film used in the invention is a material whose dissolution/dispersion in a liquor is dependent upon the concentration of any anionic and/or nonionic surfactant present in the liquor, such that the lower the concentration of anionic/nonionic surfactant in the liquor, the faster the film breaks down.

Without wishing to be bound by theory it is believed that the hydrophobic derivative within the polymeric film interacts with the anionic and/or non-ionic surfactants to form a gelled network during the duration of the wash cycle which renders the film substantially insoluble, but which breaks down during the rinse cycle so that the film becomes substantially more soluble or dispersible.

In a practical application, the release of a rinse additive will occur due to dissolution/dispersion as well as mechanical abrasion and erosion of the polymeric film. Dissolution/dispersion is influenced by the molecular properties of the polymer such as its Flory-Huggins interaction parameter, whereas the mechanical properties of the polymer are related to its rheological behaviour under external stress or strain.

Preferably the hydrophobically modified polymer has a solubility or dispersibility at 20° C. in water which contains a concentration of anionic/nonionic surfactant of greater than $1.3\times10^{-4}$ mole/L of less than 0.5 g per hour and a solubility or dispersibility of greater than 0.5 g per hour when the concentration of anionic/nonionic surfactant in water is less than $1.3\times10^{-4}$ mole/L.

According to one aspect of the invention, the package formed from the polymeric film has a relative rupture ratio of greater than 1, more preferably greater than 3, most preferably greater than 7. As defined herein, the phrase "relative rupture ratio" means the ratio of the time taken for a package to rupture in the presence of an anionic and/or nonionic surfactant relative to the time taken for the same package to rupture in demineralised water.

According to another aspect of the invention, the derivatising group attached to the backbone of the polymer is selected from a parent material having a ClogP of from 0.5 to 6, more preferably from 1 to 6, most preferably from 2 to 6, e.g. 3 to 6.

In the context of the present invention, ClogP is calculated according to the ClogP Calculator Version 4, available from Daylight Chemicals Inc.

Preferred derivatising groups include those based on parent groups selected from acetals, ketals, esters, fluorinated organic compounds, ethers, alkanes, alkenes, aromatics. Especially preferred parent groups are aldehydes such as butyraldehyde, octyl aldehyde, dodecyl aldehyde, 2-ethyl hexanal, cyclohexane carboxy-aldehyde, citral, and 4-aminobutyraldehyde dimethyl acetal, although it will be readily apparent to the person skilled in the art that other suitable parent groups having the requisite ClogP are also suitable for use in the polymeric film of the invention.

Additional modifying groups may be present on the polymer backbone. For instance, amines may preferably be included as a modifying group since this makes the polymer more soluble in response to, for instance, the change in pH and/or ionic strength from the wash liquor to the rinse liquor.

The derivatising group preferably comprises an optionally substituted hydrocarbyl chain.

According to another aspect of the invention, the hydrocarbyl chain length of the derivatising group attached to the polymeric backbone is from 4 to 22, more preferably from 4 to 20, even more preferably from 4 to 15, most preferably from 4 to 10, e.g. from 4 to 8.

Hydrocarbyl chain lengths shorter than 4 are undesirable as, in use, the gel-like structure formed at the interface of the polymeric film and any detergent surfactant will typically be too weak and will allow the package to rupture during the wash cycle rather than the rinse cycle.

Hydrocarbyl chain lengths greater than 22 are undesirable as the parent material from which the derivatising group is obtained reacts poorly or not at all with the polymeric backbone.

The hydrocarbyl chain length of the original function on the parent material from which the derivatising group is obtained is preferably from 4 to 22, more preferably from 5 to 20.

In this context, the number of carbons in the hydrocarbyl group includes any carbon within the chain attached to any other functional group within the derivatising material. For instance, butyraldehyde has a hydrocarbyl chain length of 4.

The derivatising material is preferably present in the polymer at a level of from 0.1 to 40% by weight, based on the total weight of the polymer, more preferably 2 to 30%, most preferably 5 to 15%, e.g. 8 to 12%.

Where the polymeric backbone is based on PVOH, the derivatising material is preferably present at a level such that the number ratio of the derivative groups to the free hydroxyl pairs on the backbone is from 1:3 to 1:30, more preferably 1:4 to 1:20, most preferably 1:7 to 1:15, e.g. 1:8 to 1:13.

Below a ratio of 1:30, the stability of the material during the wash phase is particularly weak and so a package may not survive intact until the rinse phase.

Above a ratio of 1:3, the resulting polymer may not fragment and/or dissolve sufficiently. This can cause high residue after the rinse phase, which is undesirable for consumers.

In the context of the present invention, "water soluble polymer" is defined as a material having a solubility in water at 20° C. of more than 0.1 g/litre, preferably more than 0.3 g/litre, most preferably more than 0.5 g/litre.

Preferred polymers from which the backbone of the derivatised polymeric film of the invention is formed include water-soluble resins such as PVOH, cellulose ethers, polyethylene oxide (hereinafter referred to as "PEO"), starch, polyvinylpyrrolidone (hereinafter referred to as "PVP"), polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Water-soluble, PVOH film-forming resins are particularly preferred.

Generally, preferred water-soluble, PVOH-based film-forming polymers should have relatively low average molecular weight and high levels of hydrolysis in water. Polyvinyl alcohol-based polymers preferred for use herein have an average molecular weight of from 1,000 to 300,000, preferably from 2,000 to 100,000, most preferably from 2,000 to 75,000. Hydrolysis, or alcoholysis, is defined as the percent completion of the reaction where acetate groups on the resin are substituted with hydroxyl, —OH, groups. A hydrolysis range of from 60–99% of PVOH-based film-forming resin is preferred, while a more preferred range of hydrolysis is from about 88–99%. As used in this application, the term "PVOH" includes polyvinyl acetate compounds with levels of hydrolysis disclosed herein.

Preferred PVOH polymers preferably have an average degree of saponification within the range from 70 to 99%, and a viscosity as a 7% solution within the range 100 to 5000 mPa.s at ambient temperature measured at a shear rate of 20 $s^{-1}$.

All of the above polymers include the aforementioned polymer classes whether as single polymers or as copolymers formed of monomer units or as copolymers formed of monomer units derived from the specified class or as copolymers wherein those monomer units are copolymerised with one or more comonomer units.

A particularly preferred polymer for use in the present invention is represented by the formula:

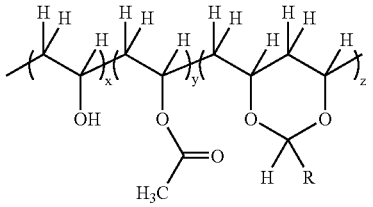

wherein the average number ratio of z to x is within the range of from 1:200 to 1:6, more preferably from 1:100 to 1:8, most preferably from 1:50 to 1:12, e.g. 1:30 to 1:14, y is the residual acetate remaining from the hydrolysis of the parent compound, which is preferably in the range of from 1–20%, more preferably 1–10%, most preferably 1–5% and R is an alkyl or alkenyl group having from 3 to 22 carbon atoms. More preferably R is an alkyl group having from 3 to 6 carbon atoms. Most preferably R is $C_3H_7$.

Cross-Linking

In order to provide a water soluble package which maintains integrity and structure during the wash cycle but which dissolves or disperses fully in the rinse cycle, it has also been found advantageous for the water soluble film to be provided as a cross-linked polymeric structure.

Particularly suitable cross-linking agents include formaldehyde; polyesters; epoxides, amidoamines, anhydrides, phenols; isocyanates; vinyl esters; urethanes; polyimides; arylics; bis(methacrylkoxypropyl) tetramethylsiloxane (styrenes, methylmethacrylates); n-diazopyruvates; phenyboronic acids; cis-platin; divinylbenzene; polyamides; dialdehydes; triallyl cyanurates; N-(-2-ethanesulfonylethyl) pyridinium halides; tetraalkyltitanates; mixtures of titanates and borates or zirconates; polyvalent ions of Cr, Zr, Ti; dialdehydes, diketones; alcohol complexes of organotitanates, zircoates and borates and copper (II) complexes.

Most preferred as the cross-linking agent is boric acid or its salt form, e.g. sodium borate.

Levels of cross-linking agent are dictated primarily by the physical parameters of the film layer, e.g. molecular weight, percent hydrolysis and thickness, and secondarily by the additive and wash conditions. The level of cross-linking agent, if present, is from about 0.05% to 9% by weight of the film, more preferably 1% to 6%, most preferably about 1.5% to 5% by weight. The upper range will, of course, result in more cross-linking and a slower rate of dissolution or dispersion of the film in the rinse cycle.

Functionally, it is believed that the cross-linking agent reduces the solubility of the film polymer by increasing its effective molecular weight. While it is preferred to incorporate the cross-linking agent directly into the film polymer, it is also within the scope of the invention to maintain the film in contact with the cross-linking agent during the wash. This may be done by adding the cross-linking agent to the wash solution, or by encasing it within the film polymer. If the cross-linking agent is added in this manner, somewhat higher levels are needed to sufficiently cross-link the film polymer, and should range from about 1–15% by weight.

For PVOH-based films, the preferred cross-linking agent is a metalloid oxide such as borate, tellurate, arsenate, and precursors thereof. Other known cross-linkers include the vanadyl ion, titanium ion in the plus three valence state, or a permanganate ion (disclosed in patent U.S. Pat. No. 3,518,242). Alternative cross-linkers are given in the book:

Polyvinylalcohol—Properties and applications, Chapter 9 by C. A. Finch (John Wiley & Sons, New York, 1973).

Plasticiser and/or Crystallinity Disruptor

The film preferably incorporates a plasticiser and/or crystallinity disrupter.

It is to be understood that the term "plasticiser" and phrase "crystallinity disrupter" are interchangeable such that a reference to one is an implicit reference to the other.

The plasticiser influences the way the polymer chains react to external factors such as compression and extensional forces, temperature and mechanical shock by controlling the way that the chains distort/realign as a consequences of these intrusions and their propensity to revert or recover to their former state. The key feature of plasticisers is that they are highly compatible with the film, and are normally hydrophilic in nature.

The plasticiser will depend on the nature of the film in question.

Generally, plasticisers suitable for use with PVOH-based films have —OH groups in common with the —CH2-CH(OH)—CH2-CH(OH)— polymer chain of the film polymer.

Their mode of functionality is to introduce short chain hydrogen bonding with the chain hydroxyl groups and this weakens adjacent chain interactions which inhibits swelling of the aggregate polymer mass—the first stage of film dissolution.

Water itself is a suitable plasticiser for PVOH films but other common plasticisers include:

Polyhydroxy compounds, e.g. glycerol, trimethylolpropane, diethylene glycol, triethylene glycol, sorbitol, dipropylene glycol, polyethylene glycol; starches, e.g. starch ether, esterificated starch, oxidized starch and starches from potato, tapioca and wheat; cellulosics/carbohydrates, e.g. amylopectin, dextrin carboxymethylcelluose and pectin. Amines are particularly preferred plasticisers.

PVP films exhibit excellent adhesion to a wide variety of surfaces, including glass, metals, and plastics. Unmodified films of polyvinylpyrrolidone are hygroscopic in character. Dry polyvinylpyrrolidone film has a density of 1.25 $g.cm^{-3}$ and a refractive index of 1.53. Tackiness at higher humidities may be minimized by incorporating compatible, water-insensitive modifiers into the polyvinylpyrrolidone film, such as 10% of an aryl-sulfonamide-formaldehyde resin.

Suitable plasticisers for PVP-based films may be chosen from one or more of:

phosphates e.g. tris(2-ethylhexyl)phosphate, isopropyl diphenyl phosphate, tributoxyethylphosphate; polyols e.g. glycerol, sorbitol, diethylene glycol diperlargonate, polyethylene glycol di-2-ethylhexanoate, dibutyl tartrate; polyol esters e.g. hydroxy containing polycaprolactones, hydroxy containing poly-L-lactide; lower phthalates e.g. dimethyl phthalate, diethyl phthalate, dibutyl pthalate; and sulfonamides e.g. toluene sulfonamide, N-ethyltoluene sulfonamide.

Preferred water-soluble films may also be prepared from polyethylene oxide (PEO) resins by standard moulding techniques such as calendering, casting, extrusion, and other conventional techniques. The polyethylene oxide films may be clear or opaque, and are inherently flexible, tough, and resistant to most oils and greases. These polyethylene oxide resin films provide better solubility than other water-soluble plastics without sacrificing strength or toughness. The excellent ability to lay flat, stiffness, and sealability of water-soluble polyethylene oxide films make for good machine handling characteristics.

Suitable plasticisers for PEO-based films may be selected from one or more of:

phosphates e.g. tris(2-ethylhexyl)phosphate, isopropyl diphenyl phosphate, tributoxyethylphosphate; polyols e.g. glycerol, sorbitol, diethylene glycol diperlargonate, polyethylene glycol di-2-ethylhexanoate, dibutyl tartrate; lower phthalates e.g. dimethyl phthalate, diethyl phthalate, dibutyl pthalate; and sulphonamides e.g. toluene sulphonamide, N-ethyltoluene sulphonamide.

If the plasticiser is present in the fabric conditioning composition, then the preferred amount of plasticiser is from 0.001% to 25%, preferably from 0.005% to 4% by weight of the composition. One or more plasticisers may independently be incorporated in the film and in the liquid composition. However, it is very much preferred for the identity of the plasticiser(s) in the film and in the liquid composition to be substantially the same.

The plasticiser and/or crystallinity disruptor can be physically bound to the backbone of the polymeric material as, for instance, when the plasticiser is provided as part of the fabric conditioning composition and/or can be chemically bound to the backbone of the polymeric material, e.g. it can be covalently bound within the backbone of the polymeric film as described. A suitable method of chemically bonding the plasticiser to the backbone of the polymeric material is described in DE 10229213.2.

Protective Barrier

A protective material which provides a barrier between the film and its contents may be present in the package. Such a barrier enables a more aqueous composition, which would typically cause a package to disintegrate rapidly, to be stored within the package without causing undesirable premature release of the contents.

A particularly suitable protective barrier material is PTFE, as disclosed in U.S. Pat. No. 4,416,791.

It is also envisaged that the polymeric film can be further protected from premature disintegration by a providing a coating of anionic surfactant on the film. For instance, the film may be dusted with anionic surfactant or a powdered detergent blend or the film may be cast in the presence of an anionic surfactant.

Film Formation

Film forming on a laboratory scale can be conducted by adding an aqueous solution of the polymer, containing any plasticizers etc. to a PTFE bed, and allowing the film to form over 1 to 5 days. The resulting film thickness is nominally between 50 to 200 microns (dependent upon concentration of polymer solution, and the surface area of the PTFE bed.

The aqueous polymer solution can be cast to a controlled thickness on a commercial scale using conventional methods and techniques known in the art such as solution casting and thermo-forming techniques.

Typically, in solution casting, the aqueous polymer solutions are cast on a plate or belt using a film applicator where they are allowed to dry. The films can then be vacuum dried, air dried etc. followed by removal from the belt/plate. Casting techniques are described in U.S. Pat. No. 5,272,191 issued Dec. 21, 1993, to Ibrahim et. al. which is incorporated herein for reference.

Films can also be prepared using a melt process, which typically involves mixing the polymer with sufficient water to melt below its decomposition temperature. The blended polymer and water matrix is then fed to an extruder, extruded under tension through an appropriate die, cooled with air and taken up by an appropriate collection device. For making films, a tubular film can be made by blowing cool air through the centre of the tube to cool the film and to impart a biaxial stress to the film. Extrusion processes can also be used to make other shaped articles by using appropriate dies and moulds. Examples of such thermo forming processes are described in more detail in U.S. Pat. No. 5,646,206 issued Jul. 8, 1997, to Coffin et Al. incorporated herein by reference.

Water Soluble Package

Preferably the package comprising the film is a "delayed release" package. "Delayed Release" is defined herein as a package which, when placed in the drum at the beginning of the wash cycle, remains substantially intact during the wash cycle and then disperses or dissolves at the beginning of or during the rinse cycle.

In addition to the modification of the film so that its solubility is dependent upon detergent concentration in the wash liquor, a trigger source, which activates or accelerates dispersal or dissolution of the water soluble package once the rinse cycle commences may also desirably be present.

Suitable trigger sources include, for instance, those described in WO-A1-02/102956 such as sources/materials for causing changes in pH, temperature, electrolytic conditions, light, time or molecular structure. Such triggers may be used alone or in combination with each other.

The rinse conditioner formulation itself may also be designed so as to aid and/or control the dissolution or and/or dispersion of the package.

It is particularly preferred that, at wash levels of detergent, having an anionic loading of 0.05 g/L to 2 g/L (based on LAS with an average molecular weight of 242), the package remains intact for greater than 15 minutes and, at rinse levels of detergent the package breaks down and disperses within 15 minutes, more preferably within 7 minutes.

The film for the package preferably has an average thickness of from 50 to 500 μm, more preferably from 60 to 300 μm, most preferably from 65 to 250 μm.

Typically the water soluble package will be in the form of a pouch for containing a distinct fabric treatment composition. Alternatively, or additionally, the package may comprise a network or matrix of the film and fabric treatment composition where there is physical and/or chemical interaction between the film and treatment composition.

Encapsulation Methods

Any reference herein to filling refers to complete filling and also partial filling whereby some air or other gas is also trapped in the sealed envelope.

The envelope forming the package is preferably formed by horizontal or vertical form-film-seal technique.

(a) Horizontal Form-Fill-Seal

Water soluble packages based on derivatised PVOH can be made according to any of the horizontal form-fill-seal methods described in any of WO-A-00/55044, WO-A-00/55045, WO-A-00/55046, WO-A-00/55068, WO-A-00/55069 and WO-A-00/55415.

By way of example, a thermoforming process is now described where a number of packages according to the invention are produced from two sheets of water soluble material. In this regard recesses are formed in the film sheet using a forming die having a plurality of cavities with dimensions corresponding generally to the dimensions of the packages to be produced. Further, a single heating plate is used for thermoforming the film for all the cavities, and in the same way a single sealing plate is described.

A first sheet of derivatised PVOH film is drawn over a forming die so that the film is placed over the plurality of forming cavities in the die. In this example each cavity is generally dome shape having a round edge, the edges of the cavities further being radiussed to remove any sharp edges which might damage the film during the forming or sealing steps of the process. Each cavity further includes a raised surrounding flange. In order to maximise package strength; the film is delivered to the forming die in a crease free form and with minimum tension. In the forming step, the film is heated to 100 to 120° C., preferably approximately 110° C., for up to 5 seconds, preferably approximately 700 micro seconds. A heating plate is used to heat the film, which plate is positioned to superpose the forming die. During this preheating step, a vacuum of 50 kPa is pulled through the pre-heating plate to ensure intimate contact between the film and the pre-heating plate, this intimate contact ensuring that the film is heated evenly and uniformly (the extent of the vacuum is dependant of the thermoforming conditions and the type of film used, however in the present context a vacuum of less than 0.6 kPa was found to be suitable). Non-uniform heating results in a formed package having weak spots. In addition to the vacuum, it is possible to blow air against the film to force it into intimate contact with the preheating plate.

The thermoformed film is moulded into the cavities blowing the film off the heating plate and/or by sucking the film into the cavities thus forming a plurality of recesses in the film which, once formed, are retained in their thermoformed orientation by the application of a vacuum through the walls of the cavities. This vacuum is maintained at least until the packages are sealed. Once the recesses are formed and held in position by the vacuum, a liquid composition according to the invention is added to each of the recesses. A second sheet of polyvinyl alcohol film is then superposed on the first sheet across the filled recesses and heat-sealed thereto using a sealing plate. In this case the heat sealing plate, which is generally flat, operates at a temperature of about 140 to 160° C., and contacts the films for 1 to 2 seconds and with a force of 8 to 30 kg/cm$^2$, preferably 10 to 20 kg/cm$^2$. The raised flanges surrounding each cavity ensure that the films are sealed together along the flange to form a continuous seal. The radiussed edge of each cavity is at least partly formed by a resiliently deformable material, such as for example silicone rubber. This results in reduced force being applied at the inner edge of the sealing flange to avoid heat/pressure damage to the film.

Once sealed, the packages formed are separated from the web of sheet film using cutting means. At this stage it is possible to release the vacuum on the die, and eject the formed packages from the forming die. In this way the packages are formed, filled and sealed while nesting in the forming die. In addition they may be cut while in the forming die as well.

During the forming, filling and sealing steps of the process, the relative humidity of the atmosphere is controlled to ca. 50% humidity. This is done to maintain the heat sealing characteristics of the film. When handling thinner films, it may be necessary to reduce the relative humidity to ensure that the films have a relatively low degree of plasticisation and are therefore stiffer and easier to handle.

(b) Vertical Form-Fill-Seal

In the vertical form-fill-seal (VFFS) technique, a continuous tube of flexible plastics film is extruded. It is sealed, preferably by heat or ultrasonic sealing, at the bottom, filled with the liquid composition, sealed again above the liquid film and then removed from the continuous tube, e.g. by cutting.

Unit Dose Volume

The amount of the product, preferably liquid product, more preferably substantially non-aqueous liquid product, in each package is preferably from 0.5 ml to 100 ml, more preferably from 1 ml to 30 ml, most preferably from 1.5 ml to 25 ml, e.g. from 2 ml to 15 ml.

Rinse Conditioning Composition

The water soluble package is constructed so as to be able to receive a fabric treatment composition. A particularly preferred treatment composition is a rinse conditioning composition, e.g. a fabric softening composition.

It is preferable that the rinse conditioning composition is substantially non-aqueous so as to be compatible with the immediate release water soluble polymeric film.

It is desirable that the rinse conditioner can dissolve and/or disperse rapidly once it is released from the package.

In the context of the present invention, "rapidly" in relation to dispersal and/or dissolution of the rinse conditioner composition means within 20 minutes, more preferably less than 15 minutes, most preferably less than 12 minutes, e.g. less than 10 minutes in water at 25° C. or less.

In the context of the present invention, "substantially non-aqueous" means that the level of water or other aqueous components in the rinse conditioner composition is less than 20% by weight of the total weight of the rinse conditioner composition, more preferably 15% or less by weight, most preferably 10%, e.g. 5% or even 3% or less by weight.

Compositions which are compatible with the water soluble film and which dissolve and/or disperse rapidly in cold water include the following:

Substantially non-aqueous concentrated melts, concentrated emulsions and microemulsions.

For the purposes of the present invention, a substantially non-aqueous concentrated melts is defined as a fabric conditioning composition present in solid form, such as particles, at a specified temperature, the solid being suspended in an oil matrix and containing less than 20 wt %, preferably less than 5 wt % of water.

A substantially non-aqueous concentrated rinse conditioner emulsion is defined as a mixture of a quaternary ammonium softening material, an oil and water comprising more than 10 wt % of the quaternary ammonium material and less than 20 wt % of water.

A substantially non-aqueous microemulsion is defined as a composition comprising less than 20% by weight water, wherein the composition is clear, isotropic and thermodynamically stable across a range of temperatures.

The following conventional ingredients are optionally present in the compositions compatible with the packages used in the invention.

Cationic Fabric Softening Compound

The fabric softening compound is selected from those typically included in rinse-added fabric softening compositions.

It is especially preferred if the cationic softening agent is a water insoluble quaternary ammonium material which comprises a compound having two $C_{12-18}$ alkyl or alkenyl groups connected to the nitrogen head group via at least one ester link. It is more preferred if the quaternary ammonium material has two ester links.

The first group of cationic fabric softening compounds for use in the invention is represented by formula (I):

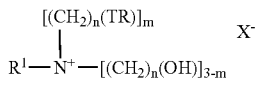

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

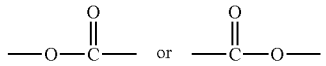

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Especially preferred materials within this class are dialkenyl esters of triethanol ammonium methyl sulphate. Commercial examples include Tetranyl AHT-1 (di-hardened oleic ester of triethanol ammonium methyl sulphate 80% active), AT-1(di-oleic ester of triethanol ammonium methyl sulphate 90% active), L5/90 (palm ester of triethanol ammonium methyl sulphate 90% active), all ex Kao, and Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation.

The second group of cationic fabric softening compounds for use in the invention is represented by formula (II):

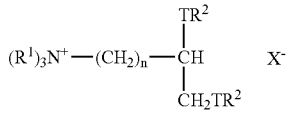

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and X are as defined above.

Preferred materials of this class such as 1,2bis[tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein.

A third group of cationic fabric softening compounds for use in the invention is represented by formula (III):

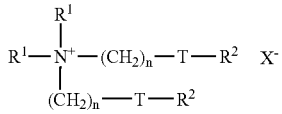

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above. A preferred material within this class is N,N-di(tallowoyloxyethyl)-N,N-dimethyl ammonium chloride.

A fourth group of cationic fabric softening compounds for use in the invention is represented by formula (IV):

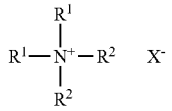

(IV)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above.

Preferably, the compositions are provided as superconcentrates comprising from 25–97% by weight of cationic surfactant (active ingredient) based on the total weight of the composition, more preferably 35–95% by weight, most preferably 45–90% by weight, e.g. 55–85% by weight.

If the quaternary ammonium softening agent comprises hydrocarbyl chains formed from fatty acids or fatty acyl compounds which are unsaturated or at least partially unsaturated (e.g. having an iodine value of from 5 to 140, preferably 5 to 100, more preferably 5 to 60, most preferably 5 to 40, e.g. 5 to 25), then the cis:trans isomer weight ratio of the chains in the fatty acid/fatty acyl compound is greater than 20:80, preferably greater than 30:70, more preferably greater than 40:60, most preferably greater than 50:50, e.g. 70:30 or greater. It is believed that higher cis:trans isomer weight ratios afford the compositions comprising the compound better low temperature stability and minimal odour formation. Suitable fatty acids include Radiacid 406, ex. Fina.

Saturated and unsaturated fatty acids/acyl compounds may be mixed together in varying amounts to provide a compound having the desired iodine value.

Fatty acids/acyl compounds may also be, at least partially hydrogenated to achieve lower iodine values.

Of course, the cis:trans isomer weight ratios can be controlled during hydrogenation by methods known in the art such as by optimal mixing, using specific catalysts and providing high $H_2$ availability.

For improved rapid dispersion and/or dissolution of the composition after its release from the water soluble package, it is preferred that the fatty acyl compounds or fatty acids from which the softening compound is formed have an average iodine value of from 5 to 140, more preferably 10 to 100, most preferably 15 to 80, e.g. 25 to 60.

Iodine Value of the Parent Fatty Acid

The method for calculating the iodine value of a parent fatty acyl compound/acid is The method for calculating the iodine value is as described in WO-A1-01/04254.

Oily Sugar Derivatives

Oily sugar derivatives may also be present in the composition. The oily sugar derivative is preferably present in an amount of from 0.001 to 10 wt %, more preferably 0.01 to 5 wt %, most preferably 0.1 to 4 wt % based on the total weight of the composition. Preferred oily sugar derivatives are those described as CPE's or RSE's in WO-A-96/16538. A particularly preferred oily sugar derivative is a polyester of sucrose.

Formulation and Dispersion Aids

Suitable formulation and/or dispersion aids for use in the composition are preferably substantially non-aqueous. Examples include one or more of the following components:

(a) nonionic stabilising agents;

(b) polymeric stabilisers;

(c) single chain cationic surfactants;

(d) fatty alcohols or acids;

(e) short chain alcohols or oils; or (f) electrolytes

Nonionic Stabilising Agents

Suitable nonionic stabilising agents are nonionic surfactants.

Preferred nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the alkoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is preferably from 8 to 40, more preferably from 10 to 30, most preferably from 11 to 25, e.g. 12 to 22.

The level of alkoxylation, Z, denotes the average number of alkoxy groups per molecule.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO (18), and tallow alcohol-EO (25), coco alcohol-EO(10), coco alcohol-EO(15), coco alcohol-EO(20) and coco alcohol-EO(25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octa-deca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is present in an amount from 0.01 to 10%, more preferably 0.1 to 5%, most preferably 0.35 to 3.5%, e.g. 0.5 to 2% by weight, based on the total weight of the composition.

Polymeric Stabilisers

Polymeric stabilisers suitable for use in the compositions preferably comprise at least 2% by weight of water soluble groups either within the main polymer backbone or pendant thereto.

Examples of suitable polymeric materials within this class include PVA; polylactones such as polycaprolactone and polylactide; methyl cellulose; derivativised starches; derivatives of cellulose; and cationic polymers such as Guar Gum.

If present, it is desirable to incorporate such polymers at a level of from 0.01 to 5%, more preferable 0.05 to 3.5%, most preferably from 1 to 2% by weight of the polymer based on the total weight of the composition.

Single Chain Cationic Surfactants

The compositions of the invention optionally contain a single chain cationic surfactant.

The single chain cationic surfactant are particularly suitable for use in emulsions since they can be employed in the formulation to aid the dispersion characteristics of the emulsion and/or to emulsify the composition, in order to form a macroemulsion having oil droplets which are smaller than those in macroemulsion compositions comprising the cationic fabric softening agent alone.

The single chain cationic surfactant is preferably a quaternary ammonium compound comprising a hydrocarbyl chain having 8 to 40 carbon atom, more preferably 8 to 30, most preferably 12 to 25 carbon atoms (e.g. quaternary ammonium compounds comprising a $C_{10-18}$ hydrocarbyl chain are especially preferred).

Examples of commercially available single chain cationic surfactants which may be used in the compositions of the invention include; ETHOQUAD (RTM) 0/12 (oleylbis(2-hydroxyethyl)methylammonium chloride); ETHOQUAD (RTM) C12 (cocobis(2-hydroxyethyl)methyl ammonium chloride) and ETHOQUAD (RTM) C25 polyoxyethylene (15)cocomethylammonium chloride), all ex. Akzo Nobel; SERVAMINE KAC (RTM), (cocotrimethylammonium methosulphate), ex. Condea; REWOQUAT (RTM) CPEM, (coconutalkylpentaethoxymethylammonium methosulphate), ex. Witco; cetyltrimethylammonium chloride (25% solution supplied by Aldrich); RADIAQUAT (RTM) 6460, (coconut oil trimethylammonium chloride), ex. Fina Chemicals; NORAMIUM (RTM) MC50, (oleyltrimethylammonium chloride), ex. Elf Atochem.

The single chain cationic surfactant is preferably present in an amount from 0 to 5% by weight, more preferably 0.01 to 3% by weight, most preferably 0.5 to 2.5% by weight, based on the total weight of the composition.

Fatty Alcohols, Acids or Oils

The formulation aid may further be selected from fatty alcohols, acids or oils, for example $C_8$ to $C_{24}$ alkyl or alkenyl monocarboxylic acids, alcohols or polymers thereof and $C_8$ to $C_{35}$ oils. Preferably saturated fatty acids or alcohols are used, in particular, hardened tallow $C_{16}$ to $C_{18}$ fatty acids.

Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated and superconcentrated compositions may comprise from 0.5 to 20% by weight of fatty acid, more preferably 1% to 10% by weight.

Suitable fatty acids include stearic acid (PRIFAC 2980), myristic acid (PRIFAC 2940), lauric acid (PRIFAC 2920), palmitic acid (PRIFAC 2960), erucic acid (PRIFAC 2990), sunflower fatty acid (PRIFAC 7960), tallow acid (PRIFAC 7920), soybean fatty acid (PRIFAC 7951) all ex. Uniqema; azelaic acid (EMEROX 1110) ex. Henkel.

The fatty acid may also act as a co-softener in the rinse conditioner composition.

The formulation aid may comprise a long chain oil. The oil may be a mineral oil, an ester oil, a silicone oil and/or natural oils such as vegetable or essential oils. However, ester oils or mineral oils are preferred.

The ester oils are preferably hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 8, and that at least one of the hydrocarbon chains has 12 or more carbon atoms.

Suitable ester oils include saturated ester oils, such as the PRIOLUBES (ex. Uniqema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable.

It is preferred that the viscosity of the ester oil is from 0.002 to 0.4 Pa.S (2 to 400 cps) at a temperature of 25° C. at 106 $s^{-1}$, measured using a Haake rotoviscometer NV1, and that the density of the mineral oil is from 0.8 to 0.9 $g.cm^{-3}$ at 25° C.

Suitable mineral oils include branched or straight chain hydrocarbons (e.g. paraffins) having 8 to 35, more preferably 9 to 20 carbon atoms in the hydrocarbon chain.

Preferred mineral oils include the Marcol technical range of oils (ex. Esso) although particularly preferred is the Sirius range (ex. Silkolene) or Semtol (ex. Witco Corp.). The molecular weight of the mineral oil is typically within the range 100 to 400.

One or more oils of any of the above mentioned types may be used.

It is believed that the oil provides excellent perfume delivery to the cloth and also increases perfume longevity upon storage of the composition.

The oil may be present in an amount from 0.1 to 40% by weight, more preferably 0.2–20%, by weight, most preferably 0.5–15% by weight based on the total weight of the composition.

Short Chain Alcohols

The formulation aid may comprise a short chain alcohol. Preferred are low molecular weight alcohols having a molecular weight of preferably 180 or less. The alcohol may be mono or polyhydric.

The presence of the lower molecular weight alcohol helps improve physical stability upon storage by lowering the viscosity to a more desired level and also assists the formation of the micro-emulsion. Examples of suitable alcohols include ethanol, isopropanol, n-propanol, dipropylene glycol, t-butyl alcohol, hexylene glycol, and glycerol.

The alcohol is preferably present in an amount from 0.1% to 40% by weight, more preferably from 0.2% to 35%, most preferably 0.5 to 20% by weight based on the total weight of the composition.

Electrolytes

The fabric softening composition optionally comprises an electrolyte.

The electrolyte may be an inorganic or organic electrolyte.

Preferably the electrolyte is present in an amount from 0.001 to 1.5%, more preferably 0.01 to 1%, most preferably 0.02 to 0.7% by weight based on the total weight of the composition.

Suitable inorganic electrolytes include sodium sulphate, sodium chloride, calcium(II) chloride, magnesium(II) chloride, potassium sulphate and potassium chloride.

Suitable organic electrolytes include sodium acetate, potassium acetate, sodium citrate, potassium citrate and sodium benzoate.

The electrolyte improves viscosity control (especially viscosity reduction) of the compositions and assists dispersion of the composition.

Co-Active Softening Surfactants

Co-active softening surfactants for the cationic surfactant may also be incorporated in an amount from 0.01 to 20% by weight, more preferably 0.05 to 10%, based on the total weight of the composition. Preferred co-active softening surfactants are fatty amines and fatty N-oxides.

Perfume

The perfume may be any perfume conventionally used in fabric softening compositions. The perfume will thus preferably be compatible with the types fabric softening actives typically found in fabric softening compositions, although, not many commercially available perfumes will not be compatible. Also the perfume will generally be polar in nature.

The perfume used in the invention may be lipophilic in nature. By a lipophilic perfume is meant that the perfume has a solubility in water (i.e. it dissolves) of 1 g or less in 100 ml of water at 20° C. Preferably solubility in water is 0.5 g or less, preferably 0.3 g or less. Such perfumes may be referred to as water-insoluble perfumes.

Perfumes contain a number of ingredients which may be natural products or extracts such as essential oils, absolutes, resinoids, resins etc. and synthetic perfume components such as hydrocarbons, alcohols, aldehydes, ketones ethers, acids, esters, acetals, ketals, nitrites, phenols, etc. including saturated and unsaturated compounds, aliphatic, alicyclic, heterocyclic and aromatic compounds. Examples of such perfume components are to be found in "Perfume and Flavour Chemicals" by Steffen Arctander (Library of Congress catalogue card no. 75-91398).

When present, the perfume is used in a concentration of preferably from 0.01–20% by weight, more preferably from 0.05–17% by weight, most preferably from 1–10% by weight, e.g. 2 to 6% by weight based on the total weight of the composition.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, germicides, fungicides, anti-corrosion agents, drape imparting agents, anti-static agents, ironing aids crystal growth inhibitors, anti-oxidants, anti-reducing agents and dyes.

The fabric treatment composition is substantially, and preferably entirely, free of anionic detergent surfactants conventionally used as an active cleaning ingredient in a main wash detergent product.

Non-limiting examples of fully formulated compositions suitable for use in the packages of the present invention are as follows:

| Composition | 1 | 2 |
|---|---|---|
| Quat[a] | 93–99 | — |
| Quat[b] | — | 22.8 |
| Sirius M85[c] | — | 39.2 |
| ER 290[d] | — | 15 |
| Hexylene Glycol | — | 10 |
| Tergitol 15-S-7[e] | — | 6 |
| Perfume | 1–4 | 4 |
| Water | 0–5 | 3 |

[a]Tetranyl AOT-1 ex Kao (80% active in 20% dipropylene glycol);
[b]dihardened tallow dimethyl ammonium chloride (75% active in 25% propylene glycol);
[c]branched mineral oil average molecular weight 288, ex Fuchs;
[d]50% esterified sucrose erucate, ex Mitsubishi Foods;
[e]Secondary alkyl alcohol with an average degree of ethoxylation of 7, ex Union Carbide.

| Composition | 3 | 4 | 5 | 6 |
|---|---|---|---|---|
| Quat[a] | 35 | 35 | 35 | 35 |
| Perfume | 3 | 3 | 3 | 3 |
| Estol 1545[b] | 27 | 27 | 27 | 27 |
| Estasol[c] | 10 | | | |
| NMP[d] | | 10 | | |
| DMSO[e] | | | 10 | |

-continued

| Composition | 3 | 4 | 5 | 6 |
|---|---|---|---|---|
| Benzyl alcohol | | | | 10 |
| Coco-3[f] | 5 | 5 | 5 | 5 |

[a]1,2-ditallowoyloxy ethyl, 3-trimethyl ammoniopropane chloride
[b]ester oil
[c]mixture of methyl esters of adipic, glutaric and succinic acids
[d]N-methyl pyrrolidone
[e]Dimethyl sulphoxide
[f]Coco-alcohol 3 EO The compositions were prepared by heating the ingredients under stirring to 80° C. until clear, and then leaving to cool to ambient temperature under low shear mixing, to form soft-solid pastes, or gels.

It will be readily apparent to the person skilled in the art that the compositions hereinabove as merely examples and many more compositions will be compatible with the polymeric film.

For instance, a suitable melt can be prepared by heating a reaction vessel to at least 50° C., adding an oil and a nonionic surfactant to the vessel and stirring the mixture. A cationic surfactant and a fatty acid and/or a long or short chain alcohol are then added to the vessel, and the stirring rate is increased. Stirring is continued until a homogenous mixture is formed. The mixture is then left to cool to ambient temperature, under continuous stirring. Optionally perfume and/or a polymeric structurant (such as disclosed in WO99/43777) is then stirred into the mixture.

A suitable microemulsion is prepared by mixing under low agitation an oil, a solvent such as a low molecular weight alcohol, a dispersibility aid such as a nonionic surfactant, a cationic surfactant and 10% by weight or less of water until a clear composition is formed. In order to assist formation of the clear microemulsion, the mixture may be heated as required. Perfume may optionally be added to the mixture at any stage.

A suitable a concentrated emulsion is prepared by heating water to a temperature above 50° C., adding an emulsifier, premixing a cationic surfactant, nonionic surfactant and oil and adding this to the water. Optionally the product is milled and then allowed to cool. Once below 50° C., perfume may be added.

Product Form

The water soluble package is preferably in the form of a capsule which contains but does not interact with the fabric treatment composition. A suitable alternative is a package comprising a polymeric matrix which incorporates the fabric treatment composition.

Composition pH

When the fabric treatment composition is dispersed in water, the solution preferably has a pH of from 1.5 to 5.

Product Use

In a preferred method of use, the water soluble package is placed in the drum of the washing machine at the beginning of the wash cycle for dissolution and/or dispersion at the beginning of or during the rinse cycle.

EXAMPLES

The invention will now be illustrated by the following non-limiting examples. Further modification within the scope of the present invention will be apparent to the person skilled in the art.

Samples of the invention are denoted by a number and comparative samples are denoted by a letter. All amounts are % by weight based on the total weight of the composition unless otherwise stated.

Example 1

Preparation of Polymeric Material

A 10 wt % solution of PVOH in water was prepared by placing 100 g PVOH (Mowiol 20–98 (trade name), ex Kuraray Specialities) and 900 g demineralised water into a flask and heating to 70° C. To this, 10 ml of hydrochloric acid (36% aqueous solution) was added to catalyse the reaction and then butyraldehyde was added. The mixture was then stirred at 70° C. for 5 hours under an inert atmosphere, after which time the heating was stopped and agitation continued for a further 20 hours at room temperature. The reaction mixture was then brought to a pH of 7 using a sodium hydroxide solution.

The resulting solution was precipitated into acetone to yield the acetalised PVOH polymer and washed repeatedly with acetone (500 ml) and then water (50 ml). It was then dried under vacuum at 70° C. overnight to yield a white polymer.

The polymer was analysed by $^1$H NMR in d$^6$ DMSO.

The following peaks were observed:

| Peak p.p.m | Group | Integral | Assignment (see structure below) |
|---|---|---|---|
| 4.2–4.8 | Hydroxyl | 0.9746 | A, B, C, J |
| 3.8 | Proton | 1.0000 | D |
| 3.4 | Water | 0.8219 | |
| 2.5 | d$^6$ DMSO | 0.1181 | |
| 1.8 | Methyl on acetate[a] | 0.0529 | E |
| 1.2–1.6 | Proton | 2.2762 | F, G |
| 0.9 | Methyl | 0.1609 | H |

[a]Acetate present as residual function after saponification from poly(vinylacetate) to form the poly(vinylalcohol) prior to acetalisation with butyraldehyde to form the final polymer.

This is believed to correspond to the structure:

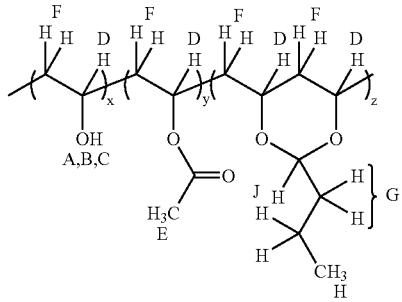

wherein the average number ratio of z to x is within the range of from 1:30 to 1:14, and y is from 1–5%.

The degree of acetalisation was calculated from the number of hydroxyl pairs as follows:

H, which represents the "$CH_3$" group from the acetal product, was found by integration to be 0.1609.

Therefore the number of acetal repeats each containing an OH pair was 0.1609/3 or 0.0536.

A, B and C represent the number of free OH groups. J represents a hydrogen from the acetal ring. A, B, C and J combined is 0.9746.

The total integration due to A, B and C is 09746—J or 0.9746–0.0536, i.e. 0.921.

The total number of OH repeat units that remain unreacted is 0.921/2 or 0.4605.

Accordingly, the degree of acetal content with respect to the total number of OH pairs available is 0.0536/(0.0536+0.4605)*100 or 10.43% acetal with respect to OH pairs available.

Preparation of Polymeric Film

The poly(vinylalcohol)-butyral (PVA-BA) resin prepared in example 1 was diluted to a 7% m/m. solution with demineralized water. The resulting solution was poured onto a PTFE glued-sheet tray. The polymer solution was then left to evaporate to produce films. The thickness of the films was adjusted by increasing or decreasing the volume of liquid polymer dosed in a given space. After 2 to 3 days, the films were peeled away from the PTFE tray, and an average thickness was measured at 5 regions of the cast films using an electronic micrometer. The films were then stored at 23° C. and 50% relative humidity for 2 days prior to evaluation.

The following examples illustrate the effect of anionic/nonionic surfactant concentration on the butyraldehyde-derivatised PVOH. The slide-test method described below was employed as a screen for the polymer films.

Example 1

Film Rupture Testing

The evaluation of the effect of anionic/nonionic surfactant concentration on the polymer material is made based on its dissolution and erosion characteristics using a slide-testing regime.

This is denoted by the rupture time, i.e. the first time when the polymer breaks and the contents flow from the inside of the sachet into the surrounding liquid.

A film slide was used to hold a 30 mm×30 mm film cast to a thickness of 100–200 μm, in place. The slide and film were then immersed in either a detergent surfactant solution or tap water in a 1 litre beaker. The slide and film to be tested were stirred at ambient temperature at 293 rpm until the polymer film ruptured.

The nature of the films tested is given in the table below.

TABLE 1

| Sample | Film thickness[a] | Base[b] | Degree modified[c] | Solids[d] | mPa · s[e] |
|---|---|---|---|---|---|
| 1 | 184 | 20–98 | 9 | 15.53 | 20.6 |
| 2 | 150 | 20–98 | 11 | 15.6 | 20.8 |
| 3 | Not measured | 20–98 | 12 | 15.7 | 21.1 |
| 4 | 192 | 26–88 | 10 | 15.46 | 23.4 |
| 5 | 173 | 26–88 | 12 | 15.6 | 26.2 |
| 6 | 149 | 28–99 | 10 | 10.83 | 24.2 |
| 7 | 166 | 28–99 | 11 | 10.75 | 25.6 |
| 8 | 110 | 28–99 | 12 | 10.81 | 24.11 |
| 9 | 185 | 20–98 | 10 | 15.6 | 20.7 |

[a]μm. Average of 5 readings across the films surface;
[b]Base hydrolyzed PVOH employed during the derivatisation (Mowiol range, ex Kuraray);
[c]Degree of butyral modifiaction (percentage of butyral group based on —OH pairs in the resin);
[d]Polymer content of base resin as supplied;
[e]Viscosity at 4% m/m measured at 20° C. on a Haake Rotoviscometer at $106^{-1}$ using an NV cup and bob.

The results are given in the table below.

TABLE 2

| Sample | Cloud point[a] | Precipitation point[b] | Rupture time in Detergent[c] | Rupture time in water[d] | $T_W/T_T$[e] |
|---|---|---|---|---|---|
| 1 | <25 | 46 | 29 | 20 | 1.5 |
| 2 | <25 | 37 | 36 | 6.5 | 5.5 |
| 3 | <25 | 35 | — | — | — |
| 4 | <25 | 31 | 7 | 5 | 1.4 |
| 5 | <25 | 28 | 0.25 | 4 | 0.07 |
| 6 | 34 | 40 | 25 | 15 | 1.7 |
| 7 | 32 | 38 | 20.3 | 2.8 | 7.25 |
| 8 | 29 | 34 | 13 | 10 | 1.3 |
| 9 | <25 | 42 | 60 | 7 | 8.57 |

[a]Temperature (° C.) at which polymer starts to become more hydrophobic due to an LCST effect;
[b]Temperature (° C.) at which precipitation of the polymer occurs due to hydrophobic LCST behaviour;
[c]Time (minutes) for the film to rupture in 1.66 g/L Ultra Wisk (trade name) at ambient temperature;
[d]Time (minutes) for the film to rupture in tap-water at ambient temperature;
[e]Ratio of rupture time in Ultra Wisk compared to tap-water.

The polymer of sample 9 was cast to a thickness of 200 μm and placed onto a slide. The effect of altering the concentration of a premium washing detergent (Ultra-Wisk, trade name) was then measured using the slide test regime at ambient temperature, as described above.

The results are given in the following table.

TABLE 3

| Detergent[a] g/L | Rupture Time, minutes |
|---|---|
| 0 | 7 |
| 0.008 | 13 |
| 0.016 | 18 |
| 0.035 | 29 |
| 1.66 | 65 |

[a]Ultra-Wisk purchased in the U.S., February 2001.

The results clearly show that the rupture time varies significantly with level of detergent.

A sample of polymer 9 was cast to 90 μm from a 15% solution. The resulting film was conditioned at 20° C. and 65% R.H. for 24 hours. A Tergometer was filled with 1 litre of cold Wirral water (15–20° FH) optionally containing 2 g/litre of Wisk solution (Wisk purchased from the U.S. May 2003) and set to agitate at 75 r.p.m. Immediately after agitation was started the film was placed in the pot, and visually inspected for fragmentation (inspection was stopped after 15 minutes). The test was repeated 3 times. The results are given in the following table:

TABLE 4

| Sample | Film weight (g) | Solution | Time to fragment (minutes) |
|---|---|---|---|
| 1 | 0.47 | A | >15 |
| 2 | 0.38 | A | >15 |
| 3 | 0.45 | A | >15 |
| 4 | 0.39 | B | 3 |
| 5 | 0.42 | B | 7 |
| 6 | 0.53 | B | 4 |

"A" is a solution of 2 g/litre of Wisk in 1 litre of cold Wirral water
"B" is 1 litre of cold Wirral water Fragmentation occurs when the polymeric film breaks into more than one piece.

Evaluation of Derivatising Groups

Films were cast using the polymer of sample 9 and various levels of butyral derivatising groups (prepared as described above). The slide test method was used to measure the rupture time in detergent ($T_W$) and the rupture time in water ($T_T$).

The results are given below.

TABLE 5

| % Butyral | $T_w$ Minutes | $T_T$ Minutes | $T_w/T_T$ |
|---|---|---|---|
| 6 | 20 | 6 | 3.33 |
| 9.3 | 40 | 16 | 2.5 |
| 12.5 | 45 | 13 | 3.46 |

$T_w$ = Time for film rupture in 1.66 g/L Wisk solution
$T_T$ = Time for film rupture in tap-water
$T_w/T_T$ = Ratio of rupture time in Wisk solution:rupture time in tap-water.

The results demonstrate that a degree of modification above 6% of butyral significantly increases rupture time.

Evaluation of Mixed Derivatising Groups

The polymer of sample 9 was reacted as previously described with butyraldehyde and propioaldehyde. The level of butyral groups was 9%. Levels of propional groups between 0 to 1.4% were used. Slide testing as described above was carried out in 1.66 g/L Wisk. The results are given in the following table.

TABLE 6

| Sample | % Butyral groups | % Propional groups | Rupture time (Tw) |
|---|---|---|---|
| 1 | 9 | 0 | 60 |
| 2 | 9 | 0.5 | 45 |
| 3 | 9 | 0.7 | 25 |
| 4 | 9 | 1.4 | 18 |

The results demonstrate that the presence of propional groups decreased the time taken for rupture to occur.

Viscosity Evaluation

The sample 9 polymer was diluted to 7% using either demineralized water or 20 g/litre SDS. The viscosity of the diluted resin was then measured.

The results are given in the following table.

TABLE 7

| SDS g/L | Viscosity, mPa · s[a] |
|---|---|
| 0 | 230 |
| 20 | 970 |

[a]Measured on a Haake Rotoviscometer at 25.4° C. and $20s^{-1}$ using an NV cup and bob.

The results demonstrate that the anionic surfactant is interacting with the polymeric film to create a gel-like structure.

Film Thickness Evaluation

The effect of film thickness on the rupture time in tap-water of film prepared from the sample 9 polymer was evaluated.

Films of various thickness were placed onto the slide and ruptured, according to the slide test regime described above.

The results are given in the table below.

TABLE 8

| Film thickness, μm | Rupture time, minutes[a] |
|---|---|
| 110 | 8 |
| 180 | 10 |
| 300 | 70 |
| 550 | 85 |

[a]measured in tap-water at ambient.

As can be seen the release times can be altered to suit the environment of use e.g. thickness and surfactant concentration can be coupled to decrease or increase active release.

Evaluation of Plasticiser

The sample 9 polymer was formed into films according to the method described above in the presence of various concentrations of sorbitol. The rupture time at ambient temperature in tap-water was evaluated using the slide test regime.

The results are given in the following table.

TABLE 9

| % Sorbitol[a] | Rupture time, mins. |
|---|---|
| 0 | 15 |
| 0.1 | 10 |
| 5.0 | 7 |
| 10 | 4 |

[a]Sorbitol added to the base resin prior to casting (percentage by weight based on the solids of the diluted starting resin, i.e. 7% m/m).

Evaluation of Enzymes

It is undesirable for enzymes in washing formulations to have any significant effect on the time at which rupture occurs.

Films were cast from the sample 9 polymer, as above, and immersed in an enzyme-containing premium detergent (Persil Performance, trade name), and an enzyme-free detergent (Persil Non-Biological liquid) at 8 g/litre of water. The rupture times were measured using the slide test regime.

The results are given in the following table.

TABLE 10

| Detergent Product | Concentration, g/L | Rupture time, mins |
|---|---|---|
| None | N/A | 10 |
| Persil Non-Biological | 8 | 120 |
| Persil Performance | 8 | 120 |

The results illustrate that the enzymes in the liquids had no adverse effect on the rupture time.

Evaluation of Cationic Surfactant

A cast film of the sample 9 polymer was screened using the slide-test regime as described above in the presence of varying concentrations of cetyltrimethylammonium chloride (CTAC).

The results are given in the following table.

TABLE 11

| Concentration of CTAC (g/L) | Rupture time (mins) |
|---|---|
| N/A | 30 |
| 0.2 | 28 |
| 2.0 | 30 |

It can be seen that varying the concentration of the cationic surfactant has substantially no effect on the time of rupture.

Evaluation of pH Variation

A film of the sample 9 polymer cast at 200 μm thickness was evaluated for rupture time in tap-water at various pH levels. The results are given in the following table.

TABLE 12

| pH (adjusted with HCl) | Rupture time (minutes) |
|---|---|
| 6 | 8 |
| 1.3 | 7 |

Evaluation of Film in Laundry Operation

Capsule Preparation

The sample 9 polymer was cast to form a film measuring 10 cm×10 cm and a thickness of 50 μm, 90 μm or 100 μm. This was folded in half and 3 of the 4 sides were heat sealed at 150° C. using a Hulme-Hunter heat sealer to form a pouch. 20 g of a formulation consisting of 96 wt % Tetranyl AOT-1 (a quaternary ammonium softening material based on triethanolamine, 80% active ex Kao) and 4 wt % perfume (hereinafter referred to as formulation "A") or 20 g of a formulation comprising 96 wt % Tetranyl AOT-1, 3 wt % water and 1 wt % perfume (hereinafter referred to as formulation "B") was then introduced into the pouch, and the top of the film sealed to form a capsule. The capsule was then stored at 23° C. and 50% relative humidity for 2 days prior to evaluation.

Machine Wash Evaluation

A top-loading washing machine (Whirlpool) was filled with 65 litres of water ($6^0$ French Hardness at 15° C.). 110 g washing liquid (Ultra Wisk) was added and gently agitated for 10 minutes until dissolved. 3.5 kg of a mixed ballast load comprising 1 kg Terry towel, 1 kg cotton poplin, 1 kg poly-cotton and 0.5 kg polyester was then added, together with ten 20 cm×20 cm Terry towel monitors, followed by the capsule formed from a 100 μm thick film containing formulation "A". The machine was then set for an 18 minute wash at 15° C., a spin, and one rinse (5 minutes). After the wash phase the integrity of the capsule was assessed visually, and found to be very flaccid but still intact. After the programme was finished, the cloth and drum were inspected for any residual gelled polymer film. No residual film was found.

Softness Evaluation

The Terry towel monitors were retrieved and softening was assessed after tumble drying against the tumble-dried controls by a trained panel of 10 people using paired comparison testing. Results were analysed at the 95% C.I. level.

The results are given in the following table.

TABLE 13

| Treatment | % Preference |
|---|---|
| Detergent only | 22 |
| Detergent & capsule | 78 |

The results clearly indicate that softening benefits were perceivable when the capsule was present.

Perfume Evaluation

The Terry towelling was also assessed by the panel (paired comparison test) for perfume preference both on damp cloth (5 hrs line dried) and after tumble drying.

The results are given in the following table.

TABLE 14

| Treatment | % Preference |
|---|---|
| Detergent only-assessment before tumble drying | 21 |
| Detergent & capsule-assessment before tumble drying | 79 |
| Detergent only-assessment after tumble drying | 20 |
| Detergent & capsule-assessment after tumble drying | 80 |

The results clearly indicate that significant improvements in perfume benefits are achieved when the capsule is present in the laundry treatment process.

The investigation for gelled residue was conducted on a further 3 occasions, under the machine washing conditions described in the example above. On all three occasions no residue was found either on the cloth, drum or agitator spindle.

Further Evaluation in Laundry Operation

A Whirlpool U.S. top-loader was filled with 2.5 Kg of mixed ballast (Terry towel, poly-cotton, poly-ester, cotton sheeting) with 6 terry towel monitors (20 cm×20 cm). The machine was allowed to fill with 65 litres of cold water at 15° C., and 6° F.H. 110 g of ultra-Wisk was added. A 10 or 18 minute super-wash was selected followed by a single rinse and spin. The capsules comprising formulation "B" and unencapsulated fabric treatment compositions were added at various stages of the laundry cycle. After the cycle was complete the ballast, and the monitors were dried in a Whirlpool U.S. dryer. The monitors were then isolated, and treated with bromophenol blue stain in order to indicate the intensity and evenness of cationic softener coverage.

The bromophenol blue test consisted of bromophenol blue dye (0.7 g) dissolved in ethanol (10 g), added to hot water (5 ml) and then added to 10 litres of cold Wirral water (final pH 7.4).

The monitors were added to the bromophenol blue solution, left at ambient temperature for 15 minutes with occasional agitation and then rinsed gently until the rinse waters were clear. The clothes were then spun for 30 seconds to remove any excess water, and left to line dry away from direct sunlight.

The monitors were then visually assessed via a trained panel of 8 people for evenness of deposition on a scale of 1–5 where 1 denotes very patchy and 5 denotes complete coverage, and intensity of blue stain also on a scale of 1–5 where 1 denotes very pale and 5 denotes very dark.

In the following table, the capsule was formed from a film cast to 50 microns and the 18 minute wash cycle was used.

TABLE 15

| Treatment | Evenness | Intensity |
|---|---|---|
| Capsule containing 20 g formulation "B" added at start of wash cycle | 3 | 4 |
| 20 g formulation "B" added at start of rinse cycle | 4 | 4 |
| 20 g formulation "B" added at start of wash cycle | 1 | 1 |
| 30 ml Ultra-Snuggle added at start of rinse cycle | 5 | 4 |
| Capsule containing 20 g formulation "B" ruptured by hand and added at start of wash cycle | 1 | 1 |
| 20 g formulation "B" pre-dispersed in 200 ml of demineralised water and added at start of rinse cycle | 5 | 4 |

In the following table, the capsule was formed from a film cast to 90 microns and the both the 10 and 18 minute wash cycles were used.

Softening was assessed by a trained panel of 6 people on a line scale of 0 to 100 where 0 denotes not at all soft and 100 denotes extremely soft. The results were analysed using Anova and Tukey-Kramer HSD statistics. Perfume was assessed by a trained panel of 8 people on a scale of 0 to 5 where 0 denotes no perfume and 5 denotes very intense perfume. Perfume assessment was made on the wet fabrics immediately after removal from the washing machine and also 24 hours after removal from the tumble dryer.

TABLE 16

| Treatment | Softening | Perfume (wet) | Perfume (24 Hrs) |
|---|---|---|---|
| 30 ml Ultra-Snuggle added to start of rinse cycle after end of 18 minute wash cycle | 59.2 | 2.25 | 1.88 |
| Capsule containing 20 g formulation "B" added at start of 18 minute wash cycle | 64.1 | 2.33 | 1.98 |
| Capsule containing 20 g formulation "B" added to start of rinse cycle after end of 18 minute wash cycle | 45.3 | 2.24 | 1.67 |

Evaluation of Plasticisation Via the Formulation

A plasticiser for PVOH films, PEG1500, was added to formulation "B" which was then packaged in a film formed of the sample 9 polymer cast to 90 microns.

Tactile evaluation of the film was made by a trained panel after 24 hours storage at 20° C. and 60° R.H.

The results are given in the following table.

TABLE 17

| | Sample | |
|---|---|---|
| | 1 | 2 |
| Tetranyl AOT-1 | 96 | 94 |
| Water | 3 | 3 |
| PEG1500 (1) | 0 | 2 |
| Perfume | 1 | 1 |
| Feel | Hard crispy capsule | Soft, very pliable |

(1) Poly(ethylene glycol) 1500, ex. Fisher Chemicals.

The invention claimed is:

1. A process for conditioning fabrics comprising the steps of:

adding to the beginning of a laundry wash cycle of a washing machine in the drum of the washing machine, a water soluble package comprising a polymeric film, the polymeric film comprising a polymeric backbone derived from a polymer which is water soluble, and one or more derivatising groups attached to the backbone, the derivatising group(s) being derived from a parent material comprising a C4 to C22 hydrocarbyl chain, wherein the polymeric film has a solubility or dispersibility in anionic or combinations of anionic/nonionic surfactants of more than 15 minutes when the surfactant concentration in water is greater than 0.05 g/L and a solubility or dispersibility of less than 15 minutes when the surfactant concentration in water is less than 0.05 g/L; and contacting the contents of the package with fabric in the rinse cycle of the washing machine in the drum of the washing machine.

2. A process according to claim 1 wherein the tendency of the water soluble package to break down is reduced in the presence of a fabric wash detergent active.

3. A process according to claim 1 wherein the water soluble package comprises a crystallinity disruptor and/or a plasticizer physically or chemically bound to the backbone of the polymeric film.

4. A process according to claim 1 wherein the polymeric backbone is derived from PVOH.

5. A process according to claim 1 wherein the parent material from which the derivatising group is obtained is selected from the group consisting of acetals, ketals, esters, fluoro-organics, ethers, epoxides, alkanes, alkenes and aromatic compounds.

6. A process according to claim 1 wherein the parent material from which the derivatising group is obtained is an aldehyde.

7. A process according to claim 1 wherein the polymer has an average degree of saponification of from 70 to 99%.

8. A process according to claim 1 wherein the degree of derivatisation of the polymeric backbone by the derivatising group is from 0.1 to 40% by weight, based on the total weight of the polymer.

9. A process according to claim 1 wherein the polymer has an average degree of saponification of from 80 to 99%.

10. A process according to claim 1 wherein the polymer has an average degree of saponification of from 88 to 99%".

11. A process according to claim 1 wherein the degree of derivatisation of the polymeric backbone by the derivatising group is from 2 to 30% by weight, based on the total weight of the polymer.

12. A process according to claim 1 wherein the degree of derivatisation of the polymeric backbone by the derivatising group is from 5 to 15% by weight, based on the total weight of the polymer.

13. A process according to claim 1 wherein the degree of derivatisation of the polymeric backbone by the derivatising group is from 8 to 12% by weight, based on the total weight of the polymer.

14. A process according to claim 1 wherein the polymer is based on PVOH and the number ratio of the derivative groups to the free hydroxyl pairs on the backbone is from 1:4 to 1:20.

15. A process according to claim 1 wherein the polymer is based on PVOH and the number ratio of the derivative groups to the free hydroxyl pairs on the backbone is from 1:7 to 1:15.

16. A process according to claim 1 wherein the polymer is based on PVOH and the number ratio of the derivative groups to the free hydroxyl pairs on the backbone is from 1:8 to 1:13.

* * * * *